US009163599B2

(12) United States Patent
Wenckel et al.

(10) Patent No.: US 9,163,599 B2
(45) Date of Patent: Oct. 20, 2015

(54) STARTING DEVICE FOR AT LEAST ONE COMBUSTION ENGINE, IN PARTICULAR CABLE PULL STARTING DEVICE

(75) Inventors: Mathias Wenckel, Hamburg (DE); Carsten Ziegs, Hamburg (DE)

(73) Assignee: MAKITA CORPORATION, Anjo-shi (JP)

( * ) Notice: Subject to any disclaimer, the term of this patent is extended or adjusted under 35 U.S.C. 154(b) by 849 days.

(21) Appl. No.: 13/409,763

(22) Filed: Mar. 1, 2012

(65) Prior Publication Data

US 2012/0234283 A1 Sep. 20, 2012

(30) Foreign Application Priority Data

Mar. 17, 2011 (DE) ..... 20 2011 000 610 U

(51) Int. Cl.
*F02N 3/02* (2006.01)
*F02N 5/02* (2006.01)
*F02N 15/06* (2006.01)

(52) U.S. Cl.
CPC ... *F02N 3/02* (2013.01); *F02N 5/02* (2013.01); *F02N 15/063* (2013.01); *F02N 15/065* (2013.01)

(58) Field of Classification Search
CPC ..... F02N 15/063; F02N 15/065; F02N 3/02; F02N 5/02
USPC ..... 123/185.14, 185.2, 185.3, 185.4; 185/39, 41 A, 41 C, 41 R; 16/75; 267/154, 155, 177, 178, 179, 151
See application file for complete search history.

(56) References Cited

U.S. PATENT DOCUMENTS

| | | | | | |
|---|---|---|---|---|---|
| 2,477,822 | A * | 8/1949 | Probst | ..... | 280/124.153 |
| 2,577,760 | A * | 12/1951 | Hickman | ..... | 280/124.143 |
| 2,592,714 | A * | 4/1952 | Krautheim | ..... | 105/190.2 |
| 2,820,646 | A * | 1/1958 | Joachim | ..... | 280/124.103 |
| 4,181,208 | A * | 1/1980 | Davis | ..... | 192/207 |
| 2003/0213455 | A1 * | 11/2003 | Tohyama | ..... | 123/185.3 |

(Continued)

FOREIGN PATENT DOCUMENTS

| | | | |
|---|---|---|---|
| DE | 41 35 405 | A1 | 4/1993 |
| DE | 202009011429 | U1 | 12/2010 |

(Continued)

OTHER PUBLICATIONS

German Search Report issued Nov. 10, 2011 in German Patent Application No. 20 2011 000 610.7 (with partial translation).

(Continued)

*Primary Examiner* — Erick Solis
*Assistant Examiner* — Carl Staubach
(74) *Attorney, Agent, or Firm* — Oliff PLC

(57) ABSTRACT

A starting device for at least one combustion engine, in particular cable pull starting device for at least one two-stroke or four-stroke engine, with at least one cable sheave or cable drum rotatably mounted in a housing, which for generating a driving fork for a crankshaft can be put into rotary motion by means of at least one starter handle or pulling handle via at least one force transmission means, in particular via a starter cable or pulling cable and is connected to at least one driving member, in particular to at least one pawl driver via at least one elastic coupling element, by means of which the driving torque can be transmitted to the crankshaft, the coupling link having two ends, wherein an end is in engagement with the driving member and another end with the cable sheave or the cable drum.

6 Claims, 3 Drawing Sheets

(56) References Cited

U.S. PATENT DOCUMENTS

| | | | | |
|---|---|---|---|---|
| 2004/0079313 | A1* | 4/2004 | Tsunoda et al. | 123/185.3 |
| 2004/0149249 | A1 | 8/2004 | Kruse et al. | |
| 2005/0229728 | A1* | 10/2005 | Otsuki | 74/6 |
| 2005/0252477 | A1* | 11/2005 | Schriever et al. | 123/185.14 |
| 2006/0243239 | A1* | 11/2006 | Arnold et al. | 123/185.3 |
| 2008/0283017 | A1 | 11/2008 | Sugishita et al. | |
| 2009/0194057 | A1* | 8/2009 | Kapinsky et al. | 123/185.3 |
| 2011/0048359 | A1* | 3/2011 | Wenckel | 123/185.2 |
| 2012/0132170 | A1* | 5/2012 | Wenckel et al. | 123/185.3 |
| 2013/0104834 | A1* | 5/2013 | Evans et al. | 123/185.3 |

FOREIGN PATENT DOCUMENTS

| | | | | |
|---|---|---|---|---|
| DE | 202009011429 | U1 * | 12/2010 | F02N 3/02 |
| DE | 20 2009 011 429 | U1 | 2/2011 | |
| DE | 20 2009 011 430 | U1 | 2/2011 | |
| EP | 1865196 | A1 | 12/2007 | |
| EP | 2039926 | A1 | 3/2009 | |
| EP | 2290222 | A2 | 3/2011 | |

OTHER PUBLICATIONS

Jun. 27, 2012 Search Report issued in European Application No. 12155463.8.

* cited by examiner

STARTING DEVICE FOR AT LEAST ONE COMBUSTION ENGINE, IN PARTICULAR CABLE PULL STARTING DEVICE

The invention relates to a starting device for at least one combustion engine, in particular cable pull starting device for at least one two-stroke or four-stroke engine, with at least one cable sheave or cable drum rotatably mounted in a housing, which for generating a drive torque for a crankshaft can be put into rotary motion by means of at least one starter handle or pulling handle via at least one force transmission means, in particular via a starter cable or pulling cable and via at least one elastic coupling link is connected to at least one driving member, in particular to at least one pawl driver, by means of which the drive torque can be transmitted to the crankshaft, the coupling member having two ends, wherein an end is engaged with the driving member and another end with the cable sheave or the cable drum.

PRIOR ART

The operation of a starting device for a combustion engine, in particular a cable pull starting device for a combustion engine, in particular for a two-stroke or four-stroke engine, frequently posed problems in the past because periodically high reaction forces occur during starting through the compression in the combustion engine, as a result of which changing and temporarily very high forces are acting on the hand of the operating person.

In order to reduce these particularly strong reaction forces on the handle of the starting device caused through the compression in the combustion engine and by doing so facilitate the starting operation, it is proposed for example in DE 41 35 405 to elastically cushion the fluctuations of the torque to be exerted on the crankshaft.

To this end, an elastic link is connected in between the cable sheave or cable drum and the driving member, in particular the pawl member, assigned to the force transmission means, in particular to the starter cable or pulling cable of the handle, by means of which the pulling movement imparted through handle and force transmission means during the starting operation is somewhat or completely freed of the fluctuations explained above.

With such a starting device that is known from the prior art the spring force of the coupling element acts on the cable sheave or cable drum, so that the latter has to be of a sturdy and thus heavy design.

From DE 20 2009 011 429 and DE 20 2009 011 430 it is known to configure a starting device of the type mentioned at the outset as light as possible through direct operational connection of force transmission means and elastic link/coupling link in that the elastic coupling link is connected to at least one driving member, in particular to at least one pawl driver, by means of which the driving torque can be transmitted to the crankshaft. The coupling link has two ends, wherein an end is engaged with the driving member and another end of the coupling link is engaged with the cable sheave or the cable drum and the force transmission means.

With such a starting device it has been shown to be extremely advantageous that the coupling element is acting directly on the force transmission means in the cable sheave or the cable drum is thus greatly reduced. Through such an arrangement, a light construction of the cable reel is possible, as a result of which the entire starting device also becomes lighter. Since such starting devices are frequently used in devices such as for example power chainsaws, which already have a not inconsiderable weight anyway, any weight saving is therefore desirable.

With such light spring starting systems with rotary stop known from the prior art the rotary stop is frequently located in the cable drum or in the driver. Usually, the components are embodied or produced from plastic. In the case of higher loads, for example through large-capacity engines, the loads on the plastic rotary stop significantly increase. In order to take into account the loads, the material would now have to be changed, for example reinforced plastic or aluminium could not be used.

DISCLOSURE OF THE INVENTION

The object of the present invention now is to provide a starting device which has a long lifespan even when used for different engine sizes.

This object is solved through the feature combination stated in claim 1.

According to the teaching of the present invention the coupling link is now provided with a starting device of the type mentioned at the outset in such a manner that on the coupling link a rotary stop is provided.

Here, the coupling link can be designed in different ways. It could be that the coupling link is configured for example as a three-dimensional spring, such as for example cylindrical or conical springs wound from wire or also band springs. It would also be conceivable that as with flywheels of passenger car engines, springs are tangentially arranged on the circumference.

With such a configuration of the coupling link, which acts as damping spring, the force paths can be significantly shortened. Thus, the components cable drum and/or cable sheave and/or driver can be designed in a material-saving manner.

Here, the rotary stop can now be provided at an end of the coupling link facing the driving member and/or the cable sheave or cable drum. According to a preferred embodiment, the rotary stop is designed as damping element.

With such a configuration of the invention it is now possible that force peaks, which develop when the driver springs back or upon overloading during the starting operation and act on the rotary stop and the surrounding plastic components such as cable drum, cable sheave and driver, are lessened. The components thus have a longer lifespan and can be designed lighter. In addition to this, the operating comfort for the user is also increased.

In that a damping element is now integrated on the rotary stop a possible striking and thus for example the impulse of the driver on the rotary stop when turning back and/or during the overload stop can be lessened, which results in an extension of the component lifespan and an increase of the operating comfort.

If the damping element is a rubber element, a contact surface for the driver can for example form on the two stop sides (when turning back or during overload).

Furthermore, with a starting device according to a preferred embodiment of the invention, the damping element can comprise a damping spring. This damping spring can for example be designed as spiral spring and preferentially have one or a plurality of windings.

Here it can be advantageous that the damping element has a progressive characteristic curve. If for example a rubber damping element is designed parabolically, it receives progressive damping characteristics.

According to a particularly preferred embodiment of the present invention, the damping element is designed unitarily with the coupling element.

BRIEF DESCRIPTION OF THE DRAWINGS

Preferred exemplary embodiments of the invention are explained in more detail in the following by means of the drawing. It shows.

PREFERRED EXEMPLARY EMBODIMENTS OF THE INVENTION

Figure 1:
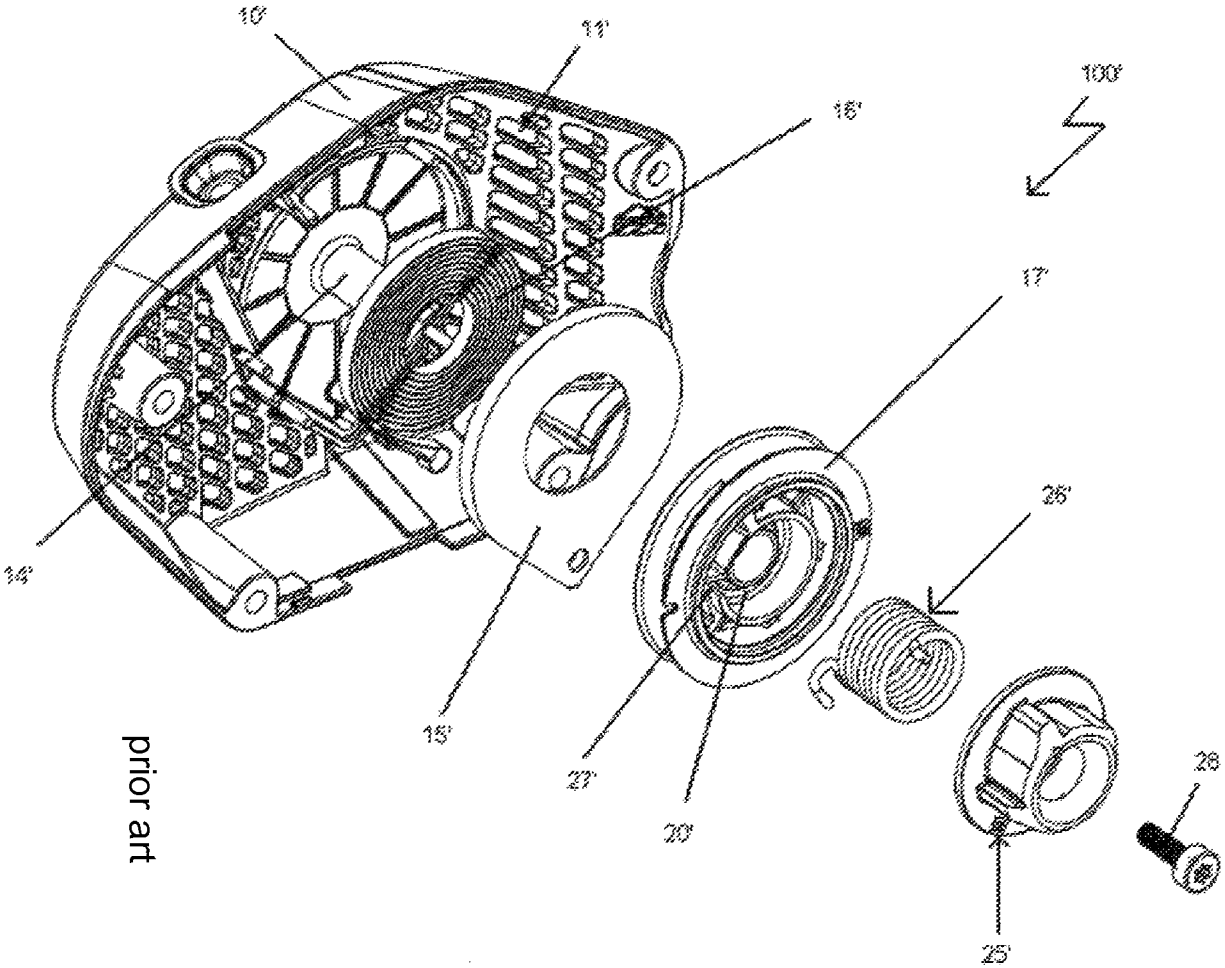
prior art Fig. 1
FIG. 1 a schematic exploded representation of a starting device according to the prior art.

FIG. 1 shows a starting device 100', as it is also already known from the prior art. Such a starting device 100' is intended for the manual starting of a combustion engine, which for example can belong to a power chainsaw. The cable pull starting device 100' is accommodated in a housing 10', which constitutes a removable lid of the engine housing provided with ventilation slits 11', in which among other things an air cowling 12' and a pole wheel 13' adjoining thereto is integrated.

From the inner wall of the housing 10' there emanates a bearing pin 14', which is surrounded by a likewise substantially housing-fixed spring housing 15' for a spiral starter spring 16' clamped in on one end at the edge of the spring housing 15'. This starter spring 16' serves as retraction spring for the cable sheave or cable drum 17'.

The cable sheave or cable drum 17' has a pin on the rear side, which protrudes into the spring housing 15' through a centre bore of said spring housing and comprises an axial slit for the engagement of the inner end of the spiral starter spring 16'.

On the cable sheave or cable drum 17', a starter cable or pull cable (not shown) is wound as force transmission element, whose free end is led out of the housing 10' and fastened to a handle. By pulling the starter cable by means of the handle, the cable sheave or cable drum 17' is put into motion about the bearing pin 14' subject to unwinding of the starter cable or pulling cable.

The cable sheave or cable drum 17' comprises a circular receiving space 20' surrounding the bearing pin 14', which is limited towards the starter spring 16' by a face wall. Between this face wall of the cable sheave or cable drum 17' and a receiving space of a pawl driving member 25', a coupling link, which in this case is designed as spiral spring 26', is arranged.

The outer, i.e. the end of the spiral spring 26' facing the face wall of the cable sheave or cable drum 17' is hooked into a slit 27', which is provided in a ring-shaped shoulder of the face wall. This shoulder encloses the spiral spring 26', whose outer winding bears against the inner wall of the shoulder. The end of the spiral spring 26' facing the pawl driving member 25' is mounted in the pawl driving member 25'.

In the assembled state of the starting device 100', the housing-fixed bearing pin 14' penetrates a centre bore of the face wall of the cable sheave or cable drum 17', so that this centre bore forms a bush-shaped mounting for the bearing pin 14'. In an axial internal thread of the bearing pin 14' a fastening screw 28' is screwed, the head of which is fastened to the pawl driving member 25'.

When the cable sheave or cable drum 17' when starting the engine is put into rotary motion by pulling the starter cable or pulling cable, the cable sheave or cable drum 17' drives the pawl driving member 25' via the spiral spring 26'. By means of this pawl driving member 25' the rotary movement of the cable sheave or cable drum 17' and thus the torque can thus be transmitted to the crankshaft to be driven, so that the engine can be started.

The spiral spring 26', as is shown in FIG. 1 according to the prior art, constitutes a cylindrical spiral spring which on the one hand is engaged with the pawl driving member 25' and on the other hand with the cable drum or cable sheave 17'.

In addition to this, it is also known from the prior art to design the spiral spring 26' in the shape of a truncated cone, the base area of which faces the cable sheave or cable drum 17', while the covering area faces the pawl driving member 25'.

A spiral spring 26' configured thus can lead to a clearly improved ventilation behaviour of the combustion engine since the inflow of the cooling air through the starting device 100' in the air cowling arranged after the starting device is improved, since the conical spring 26' follows the inflowing cooling air stream and thus positively guides the cooling air stream.

In addition to this, the compression in the combustion engine when driving or rotating the crankshaft increases in principle up to its dead centre position of the piston after which it drops again; accordingly, the reaction moment fluctuates periodically which with a conventional starting device has the effect of high force peaks that have to be exerted during starting. For offsetting this, the coupling element and in this case a spiral spring 26' according to the embodiment shown is provided.

With such a configuration, the spring develops a progressive spring characteristic curve. Thus, the spiral spring 26' is not directly deformed when a limit value is exceeded, but it is possible to initially allow the larger windings to go solid in order to subsequently utilise the smaller windings of the spiral spring 26' subject to utilising a progression, so that the rotary speed of the pawl driving member 25' also decreases in this case, while the cable sheave or cable drum 17' can be rotated further with the same rotational speed and with only moderately increasing force expenditure.

Figure 2:
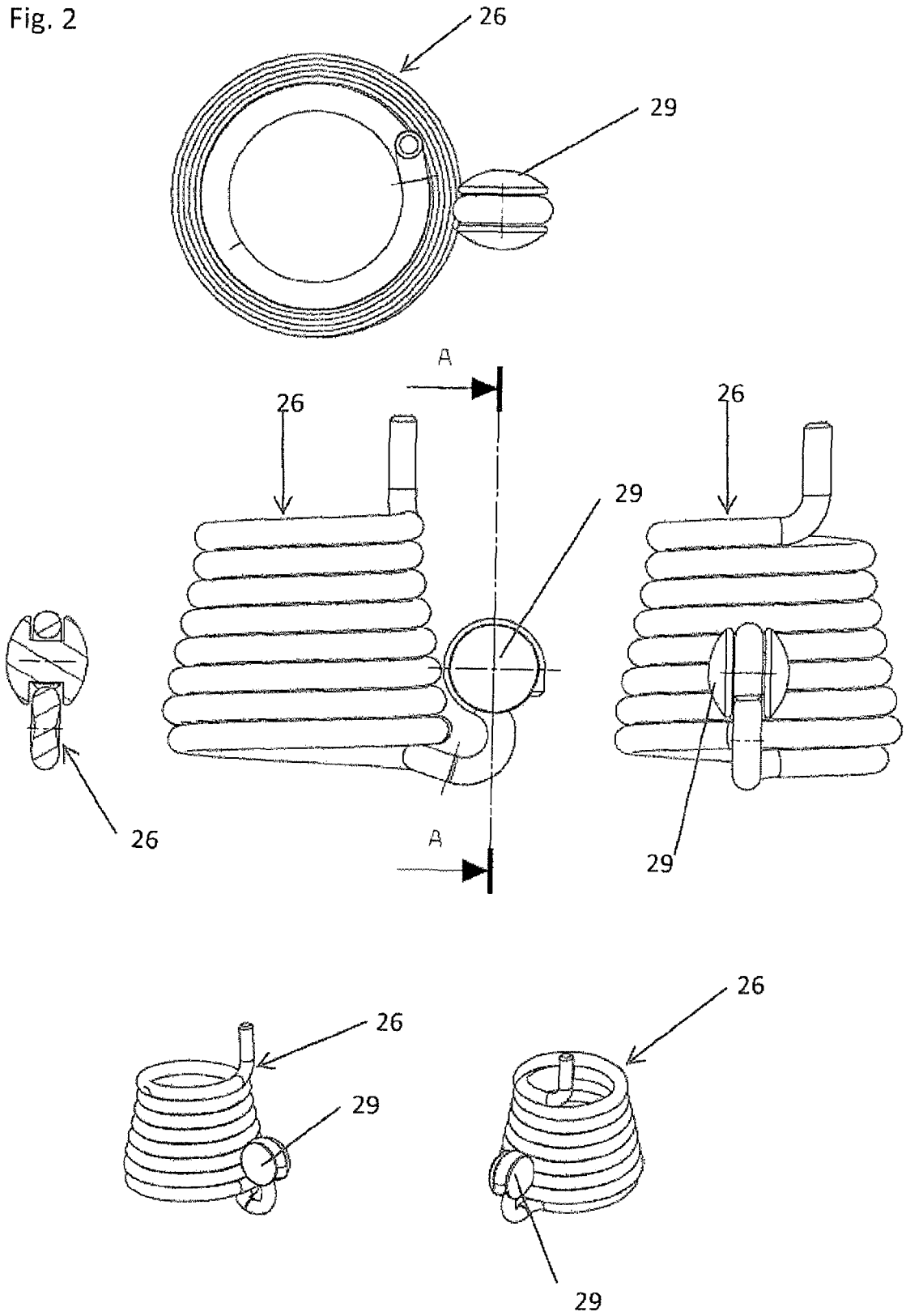
FIG. 2 a schematic representation of a coupling element with rotary stop according to a preferred embodiment of the present invention in a plurality of views, and FIG. 3 a schematic representation of a coupling link with rotary stop according to a further preferred embodiment of the present invention in a plurality of views.

In FIG. 2, a spiral spring 26 is now shown, which according to a preferred embodiment comprises a rotary stop provided with a damping element 29 on the end facing the cable sheave or cable drum 17'.

According to the shown embodiment from FIG. 2, the damping element is a rubber element.

Figure 3:
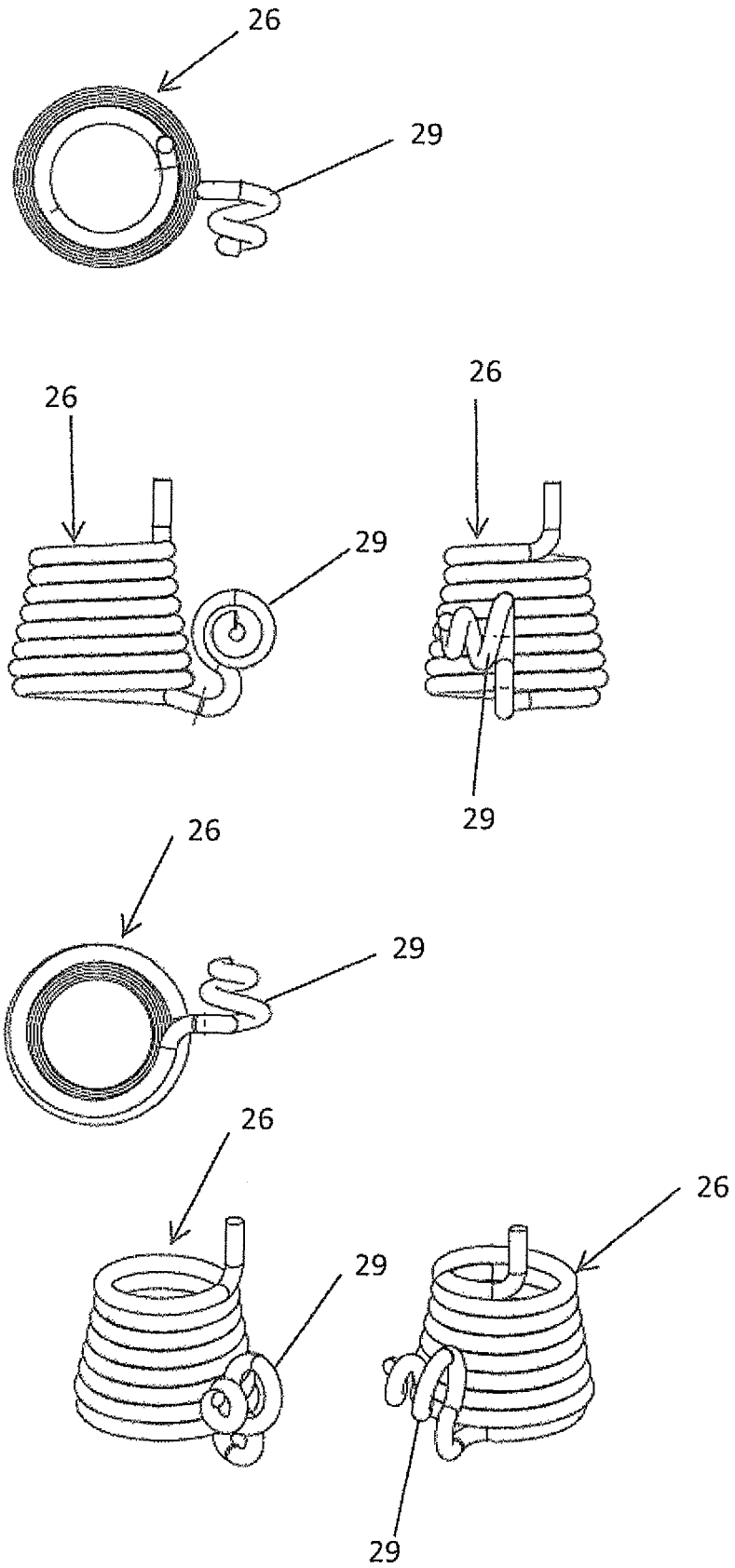

In FIG. 3, a spiral spring 26 is now shown, which according to a preferred embodiment comprises a rotary stop provided with a damping element 29 at an end facing the cable sheave or cable drum 17', which in this case is designed as damping spring and because of this according to the preferred embodiment shown is of a unitary design with the spiral spring.

LIST OF REFERENCE NUMBERS

100' Starting device
10' Housing
11' Ventilation slits
14' Bearing pin
15' Spring housing
16' Starter spring

17' Cable sheave or cable drum
20' Receiving space of cable sheave or cable drum
25' Pawl driving member
26, 26' Spiral spring
27' Slit in the face wall
28 Fastening screw
29 Rotary stop

The invention claimed is:

1. A starting device for at least one combustion engine, in particular cable pull starting device for at least one two-stroke or four-stroke engine, with at least one cable sheave or cable drum rotatably mounted in a housing, which for generating a driving torque for a crankshaft can be put into rotary motion by means of at least one starter handle or pulling handle via at least one force transmission means, in particular via a starter cable or pulling cable and is connected via at least one elastic coupling link to at least one driving member, in particular to at least one pawl driver, by means of which the driving torque can be transmitted to the crankshaft, the coupling link having two ends, wherein an end is in engagement with the driving member and another end with the cable sheave or cable drum, wherein on the coupling link a rotary stop is provided, wherein the rotary stop is designed as damping element, and wherein the damping element comprises a rubber element or the damping element comprises a damping spring wherein the damping spring comprises windings.

2. The starting device according to claim 1, wherein the coupling link comprises a spring.

3. The starting device according to claim 1, wherein the rotary stop is provided at an end of the coupling link facing the driving member and the cable sheave or the cable drum.

4. The starting device according to claim 1, wherein the damping element comprises a progressive characteristic curve.

5. The starting device according to claim 1, wherein the damping element is designed unitarily with the coupling link.

6. The starting device according to claim 1, wherein the rotary stop is provided at an end of the coupling link facing the driving member or the cable sheave or the cable drum.

* * * * *